US009134037B2

(12) United States Patent
Le Mer

(10) Patent No.: US 9,134,037 B2
(45) Date of Patent: Sep. 15, 2015

(54) EQUIPMENT FOR PRODUCING DOMESTIC HOT WATER

(75) Inventor: Joseph Le Mer, Plouezoch (FR)

(73) Assignee: Giannoni France (FR)

( * ) Notice: Subject to any disclaimer, the term of this patent is extended or adjusted under 35 U.S.C. 154(b) by 904 days.

(21) Appl. No.: 12/919,073

(22) PCT Filed: Feb. 27, 2009

(86) PCT No.: PCT/EP2009/052401

§ 371 (c)(1),
(2), (4) Date: Nov. 9, 2010

(87) PCT Pub. No.: WO2009/112385

PCT Pub. Date: Sep. 17, 2009

(65) Prior Publication Data

US 2011/0132279 A1 Jun. 9, 2011

(30) Foreign Application Priority Data

Mar. 6, 2008 (FR) ..... 08 51465

(51) Int. Cl.

| | |
|---|---|
| ***F24D 19/10*** | (2006.01) |
| ***F24D 17/00*** | (2006.01) |
| ***F24H 4/00*** | (2006.01) |
| ***F24H 4/02*** | (2006.01) |
| ***F24H 4/04*** | (2006.01) |
| ***F24H 9/06*** | (2006.01) |
| ***F24H 1/52*** | (2006.01) |

(52) U.S. Cl.

CPC ..... *F24D 17/0031* (2013.01); *F24D 19/1051* (2013.01); *F24H 1/523* (2013.01)

(58) Field of Classification Search

None

See application file for complete search history.

(56) References Cited

U.S. PATENT DOCUMENTS

| | | | | |
|---|---|---|---|---|
| 2,079,419 | A * | 5/1937 | Munters | 62/106 |
| 2,515,652 | A * | 7/1950 | Hunt et al. | 237/9 R |
| 3,045,494 | A * | 7/1962 | Gerarde | 73/864.02 |
| 3,177,659 | A * | 4/1965 | Berman | 60/39.182 |

(Continued)

FOREIGN PATENT DOCUMENTS

| | | | |
|---|---|---|---|
| CN | 1450322 | A | 10/2003 |
| CN | 200982707 | Y | 11/2007 |

(Continued)

OTHER PUBLICATIONS

International Search Report, PCT/EP2009/052401, dated Jul. 3, 2009.

*Primary Examiner* — Gregory Huson
*Assistant Examiner* — Eric Gorman
(74) *Attorney, Agent, or Firm* — Lerner, David, Littenberg, Krumholz & Mentlik, LLP

(57) ABSTRACT

The equipment of the invention includes a boiler, a hot water storage tank, a duct for supplying domestic cold water, and a duct for tapping domestic hot water, wherein said equipment is characterized in that the duct for supplying cold water comprises a T-shaped connector connected by a duct provided with a storage vessel to a re-circulation duct connecting the tank to the inlet duct, provided with a pump, of the boiler, and in that the outlet duct of the boiler is provided with a three-way valve connected by a by pass duct to said T-shaped connector, wherein said valve can selectively assume a position in which it ensures communication between the boiler outlet and the central portion of the tank, or a position in which it ensures communication between the boiler outlet and said bypass duct.

10 Claims, 6 Drawing Sheets

(56) References Cited

U.S. PATENT DOCUMENTS

| | | | | | |
|---|---|---|---|---|---|
| 3,522,909 | A * | 8/1970 | Arant | 239/127 |
| 3,645,420 | A * | 2/1972 | Machado | 222/23 |
| 3,705,574 | A * | 12/1972 | Duncan | 122/14.2 |
| 3,929,154 | A * | 12/1975 | Goodwin | 137/1 |
| 4,046,320 | A * | 9/1977 | Johnson et al. | 237/8 C |
| 4,096,039 | A * | 6/1978 | Carnine et al. | 202/205 |
| 4,102,752 | A * | 7/1978 | Rugh, II | 376/317 |
| 4,155,506 | A * | 5/1979 | Brosenius | 237/81 |
| 4,175,698 | A * | 11/1979 | Brosenius | 237/19 |
| 4,243,522 | A * | 1/1981 | Ter-Borch et al. | 210/774 |
| 4,281,519 | A * | 8/1981 | Spath et al. | 62/79 |
| 4,302,942 | A * | 12/1981 | Charters et al. | 62/235.1 |
| 4,363,221 | A * | 12/1982 | Singh | 62/238.6 |
| 4,374,506 | A * | 2/1983 | Whalen | 122/20 B |
| 4,406,136 | A * | 9/1983 | Picchiottino | 62/238.6 |
| 4,408,960 | A * | 10/1983 | Allen | 417/54 |
| 4,412,526 | A * | 11/1983 | DeGrose | 122/14.1 |
| 4,438,881 | A * | 3/1984 | Pendergrass | 237/2 B |
| 4,624,190 | A * | 11/1986 | Cappi | 110/215 |
| 4,690,102 | A * | 9/1987 | Sundquist | 202/166 |
| 4,714,821 | A * | 12/1987 | Jakobsson | 392/341 |
| 4,743,194 | A * | 5/1988 | Stellaccio | 431/23 |
| 5,174,123 | A * | 12/1992 | Erickson | 62/113 |
| 5,233,970 | A * | 8/1993 | Harris | 122/14.22 |
| 5,256,313 | A * | 10/1993 | Crafton | 210/774 |
| 5,262,013 | A * | 11/1993 | Beal et al. | 203/18 |
| 5,281,309 | A * | 1/1994 | Greene | 202/181 |
| 5,396,812 | A * | 3/1995 | Peterson | 73/863.81 |
| 5,441,606 | A * | 8/1995 | Schlesinger et al. | 203/39 |
| 5,535,596 | A * | 7/1996 | Todack | 62/85 |
| 5,618,431 | A * | 4/1997 | Kondo et al. | 210/618 |
| 5,662,779 | A * | 9/1997 | Greene et al. | 202/181 |
| 5,881,952 | A * | 3/1999 | MacIntyre | 237/7 |
| 6,251,279 | B1 * | 6/2001 | Peterson et al. | 210/636 |
| 6,275,655 | B1 * | 8/2001 | Rixen | 392/496 |
| 6,277,247 | B1 * | 8/2001 | Popov | 203/91 |
| 6,453,938 | B1 | 9/2002 | Ebster | |
| 6,594,447 | B2 * | 7/2003 | Rixen | 392/496 |
| 6,604,376 | B1 * | 8/2003 | Demarco et al. | 62/324.1 |
| 6,830,661 | B1 * | 12/2004 | Land | 202/83 |
| 6,866,092 | B1 * | 3/2005 | Molivadas | 165/104.21 |
| 7,089,955 | B1 * | 8/2006 | Komro, Sr. | 137/301 |
| 7,217,343 | B2 * | 5/2007 | Land | 203/1 |
| 7,294,258 | B2 * | 11/2007 | Leiter et al. | 210/175 |
| 7,298,968 | B1 * | 11/2007 | Boros et al. | 392/494 |
| 7,302,916 | B2 * | 12/2007 | LeMer et al. | 122/18.1 |
| 2002/0035972 | A1 * | 3/2002 | Suzuki et al. | 123/41.14 |
| 2003/0042321 | A1 * | 3/2003 | Tacchi | 237/70 |
| 2003/0131806 | A1 * | 7/2003 | Suzuki et al. | 123/41.14 |
| 2005/0056594 | A1 * | 3/2005 | Nunez | 210/664 |
| 2005/0103622 | A1 * | 5/2005 | Jha et al. | 204/237 |
| 2005/0235984 | A1 * | 10/2005 | Trihey et al. | 126/615 |
| 2006/0054305 | A1 * | 3/2006 | Ye | 165/63 |
| 2006/0102106 | A1 * | 5/2006 | Le Mer et al. | 122/32 |
| 2006/0196450 | A1 * | 9/2006 | Le Mer et al. | 122/18.1 |
| 2006/0196955 | A1 * | 9/2006 | Moxon et al. | 237/34 |
| 2006/0272933 | A1 * | 12/2006 | Domen et al. | 203/10 |
| 2007/0170273 | A1 * | 7/2007 | McIllwain | 237/19 |
| 2007/0272539 | A1 * | 11/2007 | Land | 203/10 |
| 2008/0029612 | A1 * | 2/2008 | Peckham et al. | 237/19 |
| 2010/0025488 | A1 * | 2/2010 | Park et al. | 237/2 B |
| 2010/0051713 | A1 * | 3/2010 | Back et al. | 237/2 B |
| 2011/0197600 | A1 * | 8/2011 | Hamada et al. | 62/79 |
| 2011/0259437 | A1 * | 10/2011 | Thomasson | 137/88 |
| 2013/0032036 | A1 * | 2/2013 | Zhong et al. | 99/294 |
| 2013/0075245 | A1 * | 3/2013 | Frick | 203/22 |
| 2013/0125842 | A1 * | 5/2013 | Frick | 122/7 R |
| 2013/0319348 | A1 * | 12/2013 | Hughes et al. | 122/18.2 |
| 2014/0021032 | A1 * | 1/2014 | Frick | 203/12 |
| 2014/0021033 | A1 * | 1/2014 | Frick | 203/12 |
| 2015/0090199 | A1 * | 4/2015 | Min | 122/15.1 |

FOREIGN PATENT DOCUMENTS

| | | | |
|---|---|---|---|
| EP | 0678186 | B1 | 10/1995 |
| EP | 0781968 | A1 | 7/1997 |
| EP | 1795818 | A1 | 6/2007 |
| FR | 2398976 | A1 | 2/1979 |
| FR | 2847972 | A1 | 6/2004 |
| FR | 2896856 | A1 | 8/2007 |
| WO | 2004036121 | A1 | 4/2004 |
| WO | 2005071322 | A1 | 8/2005 |

* cited by examiner

EQUIPMENT FOR PRODUCING DOMESTIC HOT WATER

CROSS-REFERENCE TO RELATED APPLICATIONS

The present application is a national phase entry under 35 U.S.C. §371 of the International Application No. PCT/EP2009/052401, filed on Feb. 27, 2009, published in French, which claims the benefit of French Patent Application No. 0851465, filed on Mar. 6, 2008, the entire disclosures of which applications are hereby incorporated herein by reference.

The present invention relates to an installation for producing sanitary hot water.

Traditionally, an installation for producing sanitary hot water, with which a dwelling is equipped, both an individual and collective one, comprises a boiler and two exchangers, one of which will be called a primary exchanger and the other one a secondary exchanger.

The boiler which for example operates with gas or fuel oil is used for heating a first liquid.

Advantageously, in the case of a so-called mixed installation, this may be water circulating in the radiators of a central heating system.

For this purpose, the boiler is equipped with the primary exchanger, which has the function of transmitting a portion of the heat generated by the burning gases from the combustion of the burner with which the boiler is equipped.

This boiler is for example of the condensation type, comprising helicoidal tubular coil(s), for example in steel, surrounding the burner and in which passes the first liquid to be heated.

Exchangers of this kind are for example described in patent documents EP-0678186 B1, WO 2004/036121 A1 and FR-A-2896856.

The first liquid, which circulates in a closed circuit, may be selected and/or treated, notably demineralized and degassed so that it does not pose any problems related to corrosion and to deposit of solid materials, notably of limestone—a source of clogging—, against the walls of the tube(s) of the primary exchanger.

These potential problems essentially result from the very high level of the applied temperatures.

In this respect, and as a simple indication, the burnt gases from the burner for example have a temperature of the order of 950° C. and the first liquid, initially at room temperature, is heated to a temperature of the order of 80° C.

The secondary exchanger has the function of transmitting heat from the first thereby heated liquid to the second liquid, in this case sanitary water, which is drawn with the purpose of supplying on demand a point of use such as a sink, a wash-basin, a shower, and/or a bathtub for example.

The sanitary hot water is stored in a heat-insulated walled enclosure, usually called a "tank".

A secondary exchanger of this kind is for example described in patent document FR-A-2847972.

In the secondary heat exchanger, the applied temperatures are considerably lower than those in the primary exchanger so that the passage inside this exchanger of sanitary water not treated beforehand—i.e. drinking water from the public water mains—does not in principle pose any critical problem of corrosion or of deposits of solid materials.

It seems to be established that so-called "hard" water, i.e. having a high lime content, is without any danger for the consumer (even if the latter is a great water drinker); however it poses serious problems of scale in conduits at a higher temperature, of the order of 60° C. to about 65° C.

Below 40° C., the problem is no longer posed.

Between these two thresholds, the problem increases with temperature.

It becomes critical from about 55° C.

Such an installation comprising a boiler and two exchangers generally gives satisfaction as regards operation, reliability and service life.

However, it has the drawback of a high cost price since it includes two distinct exchangers.

With the purpose of solving this difficulty, certain heating installers have modified the system by suppressing the second exchanger, and by having the sanitary water to be heated pass directly into the exchanger of the boiler in order to feed the storage tank.

Thus, such an installation for producing sanitary hot water comprises a boiler, a tank for storing hot water, an intake conduit for sanitary cold water, a conduit for feeding the boiler with water to be heated provided with a pump capable of ensuring circulation of the water to be heated towards the boiler when it is started and of preventing this circulation when it is at a standstill, a conduit for drawing sanitary hot water, a conduit for heated water flowing out of the boiler.

More specifically, said intake conduit for sanitary cold water is connected via a "T" connector, a so-called first connector, to the boiler feed conduit on the one hand, and to a so-called recirculation conduit on the other hand, opening out into the low portion of the hot water storage tank while the boiler outlet conduit and the water-drawing conduit open out into the central portion and into the upper portion of this tank respectively.

This installation is for example controlled in such a way that the water stored in the tank is permanently maintained at a temperature closed to 65° C., which is generally suitable for the relevant applications.

In the absence of water being drawn, the system is at a standstill, the boiler and pump are stopped.

When sanitary hot water is requested, a certain flow leaves the tank through the upper portion of this tank and is conveyed towards the point of use via the water-drawing conduit.

This causes the starting of the pump and of the boiler and an identical flow of sanitary cold water feeds the installation in order to compensate for the drawn water. At the first connector, this cold water is mixed with hot water from the low portion of the tank via the recirculation conduit, and this is the mixture (of warm water) which the pump drives back to the inlet of the boiler.

With this, it is possible to obtain operation in proper flow rate and temperature ranges of the pump and of the boiler, even if the drawn water flow rate is low or on the contrary very high.

A significant difficulty is encountered when, the sanitary water being loaded with lime, drawing of water stops. The boiler and the pump are then stopped by the control and regulation system.

Therefore, hot sanitary water, at a temperature close to 65° C. is left to stagnate in the tubing located upstream from the tank, including the inside of the boiler. The lowering of the temperature of this water in the absence of any specific device is slow. A deposit of limestone is therefore observed on the walls of the tubings of the installation as long as the temperature of the water remains above about 40° C.

This phenomenon, repeated at each drawing of water, may rather rapidly cause scale formation and make the exchanger inoperative, with which the boiler is equipped.

Another drawback encountered in this known installation lies in the fact that the energy dissipated during cooling of the stagnating water in the tubing, including in the exchanger, until the next drawing of water is definitively lost, which affects the overall energy yield of the installation.

The present invention aims at overcoming these difficulties by proposing within an installation of the aforementioned type, both eliminating or at the very least considerably reducing the risk of scale formation in its tubings while notably limiting energy losses which normally occur between successive water-drawing operations.

These objects are achieved, according to the invention, by the fact that:

- the sanitary cold water intake conduit is provided with a second "T" connector placed upstream from the first, considering the direction of circulation of cold sanitary water;
- the portion of the sanitary cold water intake conduit which connects the second and first "T" connectors is equipped with a small storage tank, the capacity of which is notably less than that of the hot water storage tank;
- the conduit for the out flow of the heated water out of the boiler is equipped with a three-way valve which is connected through a bypass conduit to the second "T" connector, this valve may selectively occupy either a so-called primary position, in which it has the boiler outlet communicate with the central portion of the tank, or a so-called secondary position, in which it has the boiler outlet communicate with this bypass conduit.

As this will be seen further on in detail, it is possible by means of this arrangement to very rapidly and effectively cool the tubing located upstream from the tank, to below about 40° C., by circulating the cold water present in the small tank when drawing of water stops, which prevents the risk of limestone deposition.

In the first phase, overall "warming" of the water present in the tubing is observed, which remains at a medium temperature while awaiting the next drawing of water, which greatly limits heat losses.

Moreover, according to a certain number of additional, non-limiting features of the invention:

- the boiler is a gas or fuel oil boiler;
- the boiler includes a gas or fuel oil burner capable of heating the water circulating in a tubular coil in stainless steel which surrounds the burner;
- the capacity of the small storage tank is approximately equal to the capacity of the whole of the tubing connected to the storage tank, downstream from the second "T" connector, including the one passing through the boiler;
- the small tank is independent of the storage tank and is located outside the latter;
- the small tank forms a compartment of the storage tank and is located in the lower portion of the latter;
- said valve is a solenoid valve;
- the installation includes at least three temperature sensors capable of measuring the temperature of the water which circulates therein, i.e.:
  - a sensor which senses the temperature inside the storage tank, in the low portion of the latter, but at a level above the one at which opens out said recirculation conduit;
  - a sensor which senses the temperature at the outlet of the boiler;
  - a sensor which senses the temperature inside the storage tank in the upper portion of the latter, in proximity to the inlet of the water-drawing conduit;
- the installation is equipped with a control and regulation circuit comprising a control unit capable of controlling the starting or stopping of the boiler and of the pump and of controlling the valve depending on temperature signals which are provided to it by these temperature sensors according to a determined operating program.

Other features and advantages of the invention will become apparent upon reading the following description of a preferred embodiment of the invention.

This description is made with reference to the appended drawings wherein.

Figure 2:
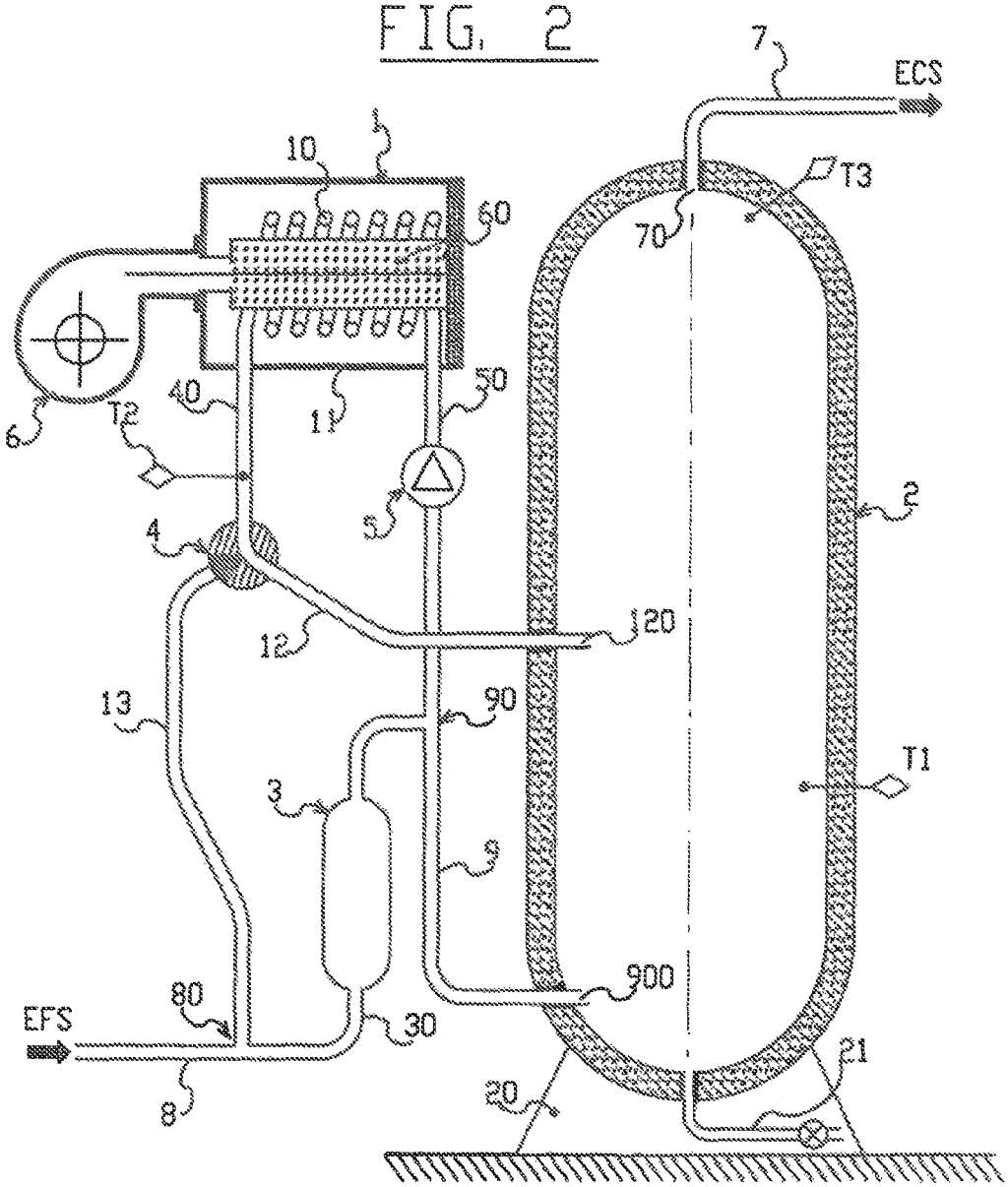
FIG. 2 is a schematic view of the installation.

With reference to FIG. 2, a sanitary hot water production installation is illustrated, connected on the upstream side, to an intake of sanitary cold water EFS, which may consist in a simple drinking water tap and, on the downstream side, to a sanitary hot water outlet ECS which supplies one or more points of use (sink, washbasin, shower, bathtub, for example).

The installation includes a boiler 1 provided with a burner 60 fed with a combustible mixture, for example a gas/air or fuel oil/air mixture, by means of a fan 6 with an adjustable flow rate.

The function of the installation is to heat up sanitary cold water by means of this boiler, and to maintain the stored sanitary hot water at a given temperature, generally of the order of 65° C. in a storage tank 2 with a heat-insulated wall, from which it may be drawn on demand in order to feed one or more points of use.

Usually, the tank has a general cylindrical shape, with a vertical axis, with hemispherical end portions, and is supported on the ground by a base 20.

The burner 60, in the illustrated embodiment, is a cylindrical burner which is surrounded in a helicoidal tubular coil 10 in stainless steel in which the water to be heated flows.

The whole is housed in a case 11 provided with a sleeve for discharging the burnt and cooled gases (not shown), for example connected to a chimney flue opening into the outside of the dwelling.

During operation, when the burner is lit and the fan is running, the burning gases generated at the surface of the burner pass through the interstices between the turns of the coil in which the water to be heated circulates radially, from the inside to the outside, and impart heat to this water, both by conduction and by condensation.

The burnt and cooled gases are then discharged via the sleeve.

This type of condensation heating apparatus is well known and will not be described in detail herein in order not to unnecessarily burden the present description.

If need be, reference may usefully be made to patent documents EP-0678186 B1, WO 2004/036121 A1 or FR-A-2896856 mentioned in the preamble.

The intake of sanitary cold water EFS into the installation is achieved by means of a conduit 8 having a "T" connector 80 allowing branching of the water flow into a conduit 30 or into a conduit 13.

Conventionally, this connector 80 will be designated as "second T connector".

The conduit 30 has a portion 3 with a notably widened diameter, forming the small storage tank.

Downstream from the small tank 3, the conduit 30 also has a "T" connector 90, which will be conventionally designated as "first T connector". The latter allows branching of the water flow into a conduit 50 or into a so-called recirculation conduit 9.

The conduit 9 through its outlet orifice 900, opens into the interior of the tank 2 in the lower portion of the latter.

The conduit 50 is provided with an electrically controlled pump 5 and is connected to the inlet of the tubular coil 10 of the boiler 1.

The outlet conduit 40 of this tubular coil 10 is, as for it, provided with a three-way valve (solenoid valve) 4. To the latter are connected the aforementioned conduit 13 from the second connector 80 on the one hand and a conduit 12 which through its outlet orifice 120 opens into the interior of the tank 2, in the middle portion (approximately at half-height) of the latter, on the other hand.

The three-way valve 4 is adapted so as to be able to selectively connect the outlet conduit 40 of the boiler with the conduit 13 or with the conduit 12.

The sanitary hot water ECS outlet conduit or water-drawing conduit 7 emerges through an inlet orifice 70 in the upper portion of the tank 2.

A standard purging system 21 is mounted in the lower portion of the tank 2.

This installation further includes three temperature probes, i.e. one $T_2$ which senses the temperature of the water conveyed by the conduit 40, at the exit of the boiler, another one $T_1$ which senses the temperature of the water present in the low portion of the tank 2, at a level located above the orifice 900 (but underneath the orifice 120) the one into which opens said recirculation conduit 9 and the third one $T_3$ which senses the temperature of the water present in the upper portion of the tank 2 in proximity to the inlet 70 of the water-drawing conduit 7.

According to an interesting feature of the invention, the capacity (contained volume) of the small tank 3 is substantially equal to the accumulated one of the conduits 9, 50, 10, 40, 13, 12 and 30 (apart from the small tank).

As an indication, for a boiler with a power of 50 kW, and a tank 2 having a capacity of 200 L, this capacity is of about 16 L.

Figure 1:
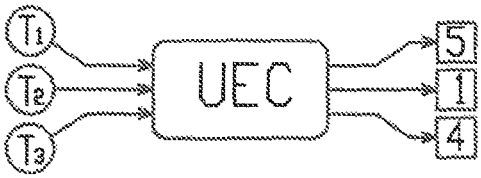
FIG. 1 is a block diagram illustrating the control of the installation.

FIG. 1 illustrates the automated control and management of the installation.

The installation includes an electronic control unit UEC, into which predetermined operating set values have been introduced by an operator (heating specialist and/or user). These are notably the optimum flow rate of the pump, the power applied in the boiler 1, and the set outflow temperature of the sanitary hot water ECS.

Depending on the temperature values measured by the sensors $T_2$, $T_2$ and $T_3$, the UEC will be able to control according to a given program, the running or stopping and the flow rate of the pump 5, the starting or stopping of the boiler 1 and its power (depending on the flow rate of the fan 6), as well as the change in the state of the valve 4, this by applying a process which will now be described with reference to FIGS. 3-6.

Figure 3:
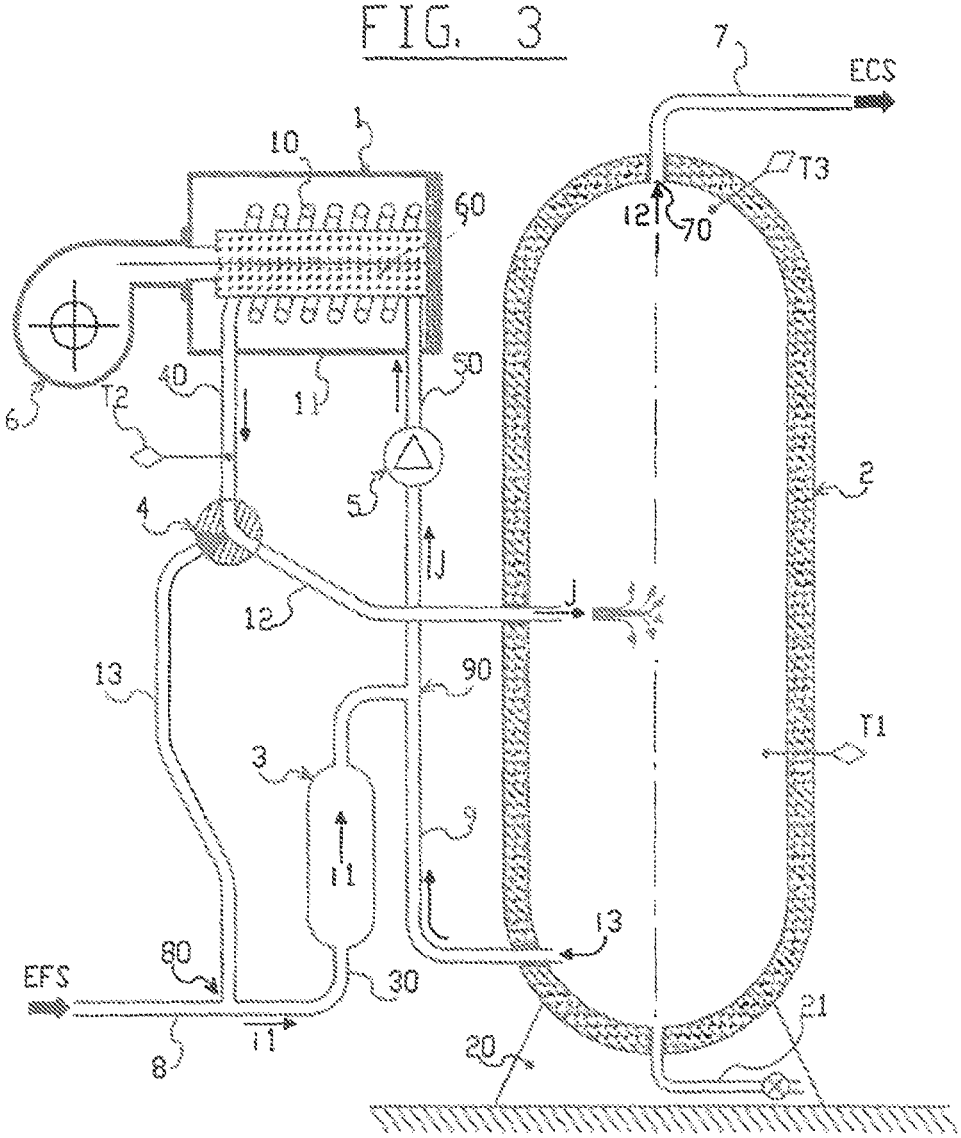
FIGS. 3-6 are views similar to that of FIG. 2 which show different phases of an operating sequence of the installation.

With reference to FIG. 3, a water-drawing situation by request of a certain flow of sanitary water ECS at a point of use is illustrated.

The boiler is operating (the fan 6 is running and the burner 60 is lit). The valve 4 is thus oriented so that the conduits 40 and 12 communicate with each other, while the conduit 13 is isolated.

The pump 5 is also running and adjusted so as to provide a sufficient flow rate for properly operating the boiler, even for a low water-drawing flow rate $i_2$. In practice, the flow rate of the pump 5 is independent of the water-drawing flow rate.

A flow of hot water $i_2$ therefore leaves the tank through the upper orifice 70 of the tank 2 and passes into the conduit 7. In order to compensate it, an identical flow of cold water $i_1$ (for example at a temperature of about 15° C.) arrives into the installation through the conduit 8. It cannot penetrate into the conduit 13, the other end of which is blocked (valve 4 is closed) and therefore entirely enters the conduit 30 and the small tank 3, in order to emerge therefrom via the first connector 90 and to feed the pump 5. It is then mixed with a flow $i_3$ which flows out of the base of the tank 2 through the recirculation conduit 9.

All in all, it is therefore a mixture of cold water (for example at about 15° C.) and of hot water (for example at about 65° C.) which is driven back by the pump 5 towards the boiler 1, with a flow rate $j=i_1+i_3$.

This mixture is heated to a temperature of 65° C., monitored by the probe $T_2$ and is distributed into the central portion of the tank 2 through the conduit 12 (arrows j).

This hot water is distributed inside the storage tank 2 while ensuring some mixing and homogenization of the temperature therein because a fraction $i_2$ flows out of it from the top and another fraction $i_3$ flows out from the bottom.

Figure 4:
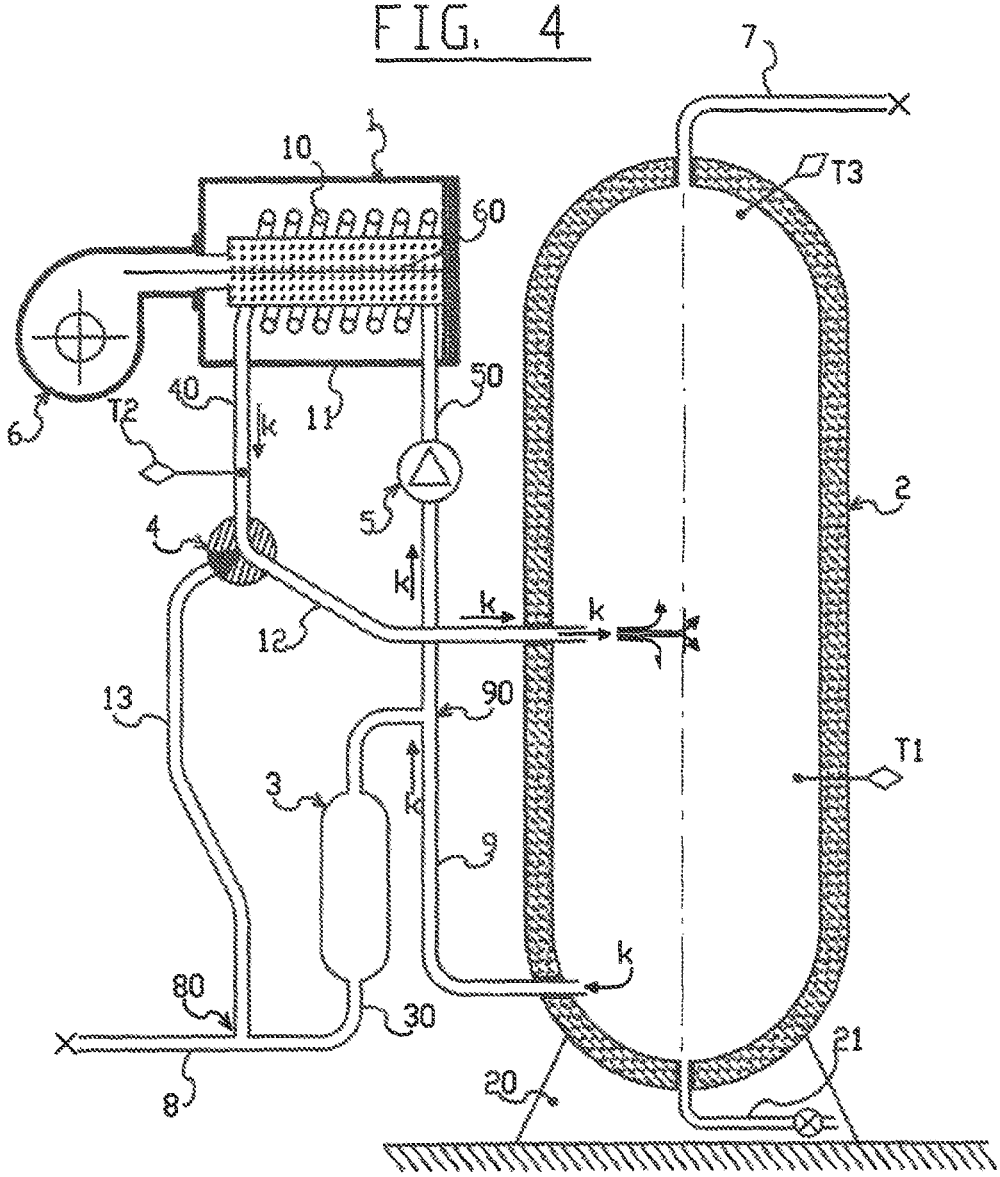

With reference to FIG. 4, a situation of stopping the drawing of water is illustrated, the conduit 7 being assumed to be closed (this is symbolized by the mark x on the figure). There is therefore no request for additional cold water in the circuit, so that the intake conduit 8 is at the pressure of the sanitary cold water network.

In a first phase which may in practice correspond to a few seconds, the UEC maintains the pump 5 and the boiler 1 running without changing the position of the valve 4.

Under these conditions, mixing of the hot water with a flow k of the water of the tank 2 being circulated in a closed circuit is observed, the flow path up to the boiler passing through the conduits 9 and 50, and the return path to the tank through the conduits 40 and 12. The small tank 3, filled with cold water, remains isolated. The probe $T_2$ regulates the power of the burner, which decreases gradually as the temperature rises in the tank 2. When the whole of the tank is at the intended temperature, as measured by the probes $T_1$ and $T_3$, the UEC controls the stopping of the burner 60.

Figure 5:
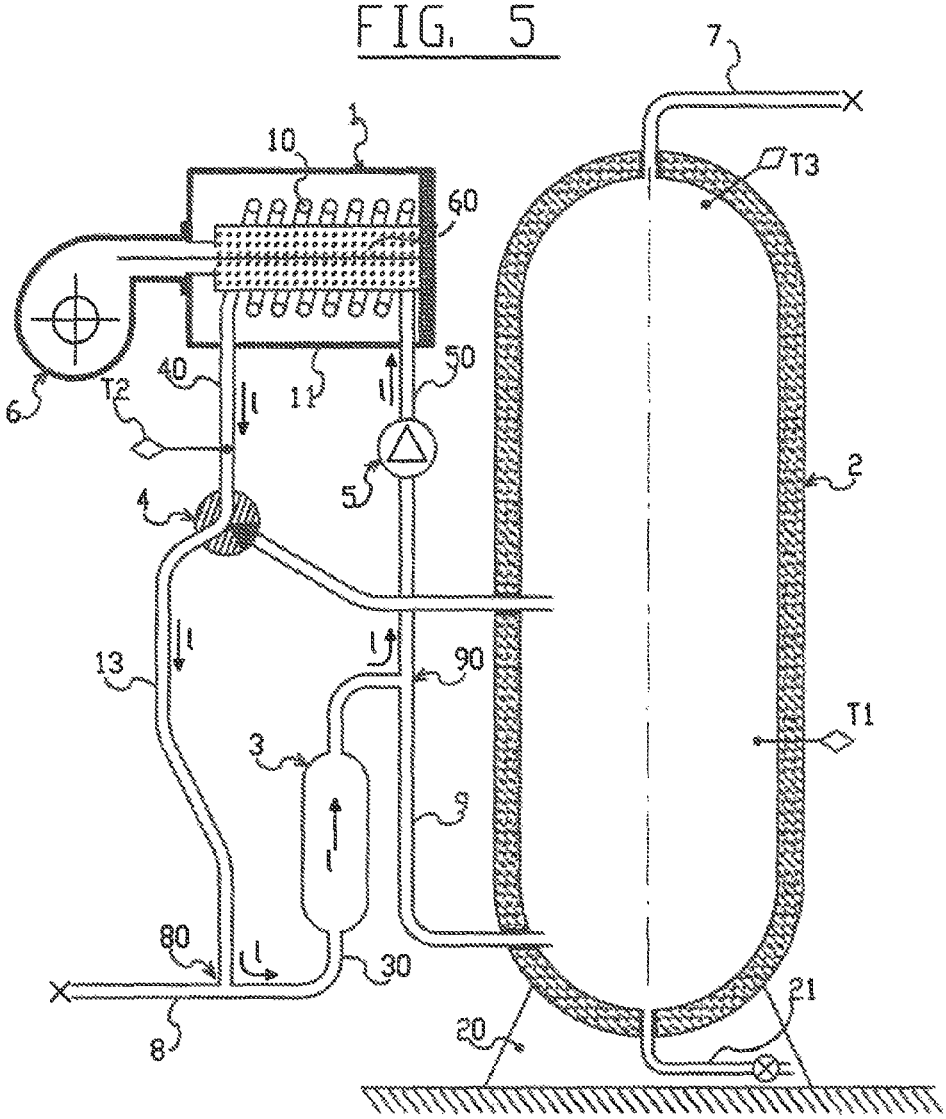

At this moment switching of the valve 4 is performed into the position illustrated in FIG. 5.

The pump 5 is kept running.

Circulation of water in a closed circuit symbolized by the arrows I in FIG. 5 from the small tank 3 to the (switched off) boiler 1 via the pump 5 and the conduit 50 and a return to the small tank via the conduit 40, the three-way valve 4 and the bypass conduit 13, are then observed.

By this arrangement, the cold water contained in the small tank 3 very rapidly causes cooling of the boiler coil 10, and the mixture of cold water provided by the small tank 3 with the dose of hot water—with a substantially equivalent volume—which is found in the tubing applied here, results in an intermediate final temperature, of the order of 35-40° C.

Finally, by suitable timing, the UEC orders stopping of the pump 5.

The water present in the conduits is thus at a too low temperature so that no limestone is deposited on the walls of these conduits with the risk of scaling them, according to the sought goal.

In the absence of water being drawn, the tank 2 remains isolated and the hot water which it contains remains at the set temperature, for example 65° C.

The UEC may be programmed so that in the case of "small amounts of drawn water", corresponding to low flow rates and/or to short periods of requesting sanitary hot water, the system remains in the previous state: boiler 1 switched off, pump 5 stopped and valve 4 in the bypass position.

Figure 6:
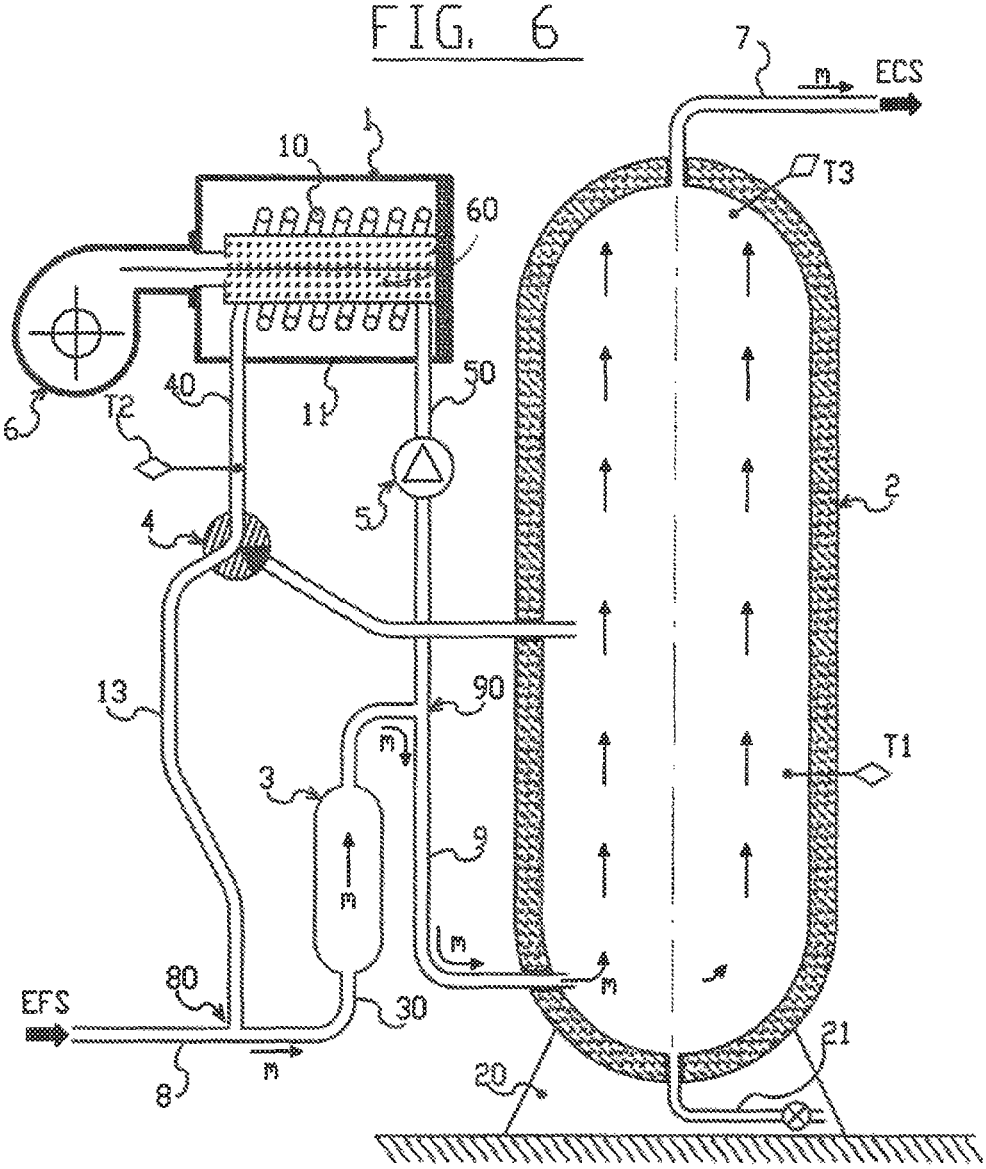

This situation is illustrated in FIG. 6.

In the case of small amounts of water being drawn, it is not advisable to start the boiler, from the moment that the reserve of hot water available in the tank 2 is sufficient for satisfying them. This notably avoids stopping/starting phases likely to be detrimental to the service life of the installation, and energy losses related to operating the boiler over short periods.

In this configuration, the sanitary cold water flow m entering through the conduit 8 is the same as that of hot water leaving the tank 2 through the conduit 7.

In a first phase, the inflowing cold water passes into the conduit 30, expels the water at an intermediate temperature which occupies this conduit, including in the small tank 3, and the mixture is driven back through the bypass conduit 9 at the base of the tank 2.

A large portion of the heat recovered in the previous step is therefore transferred in this way from the small tank 3 to the tank 2 which is favorable for the overall energy balance.

If the "small water-drawing operations" continue, either continuously or on an ad hoc basis (single shot), it is finally the cold water which arrives at the base of the tank 2. However, a relatively clear temperature transition is observed inside the latter between the lower volume (at a low temperature) and the upper volume (at a high temperature) of the water present in the tank. The level of this transient area gradually rises depending on the drawn volume and ends up by reaching the level of the probe $T_1$.

Below a determined threshold value of the temperature at this level, the UEC orders restarting of the boiler, and brings the installation back to its initial operating state corresponding to that of FIG. 2 described earlier.

Figure 7:
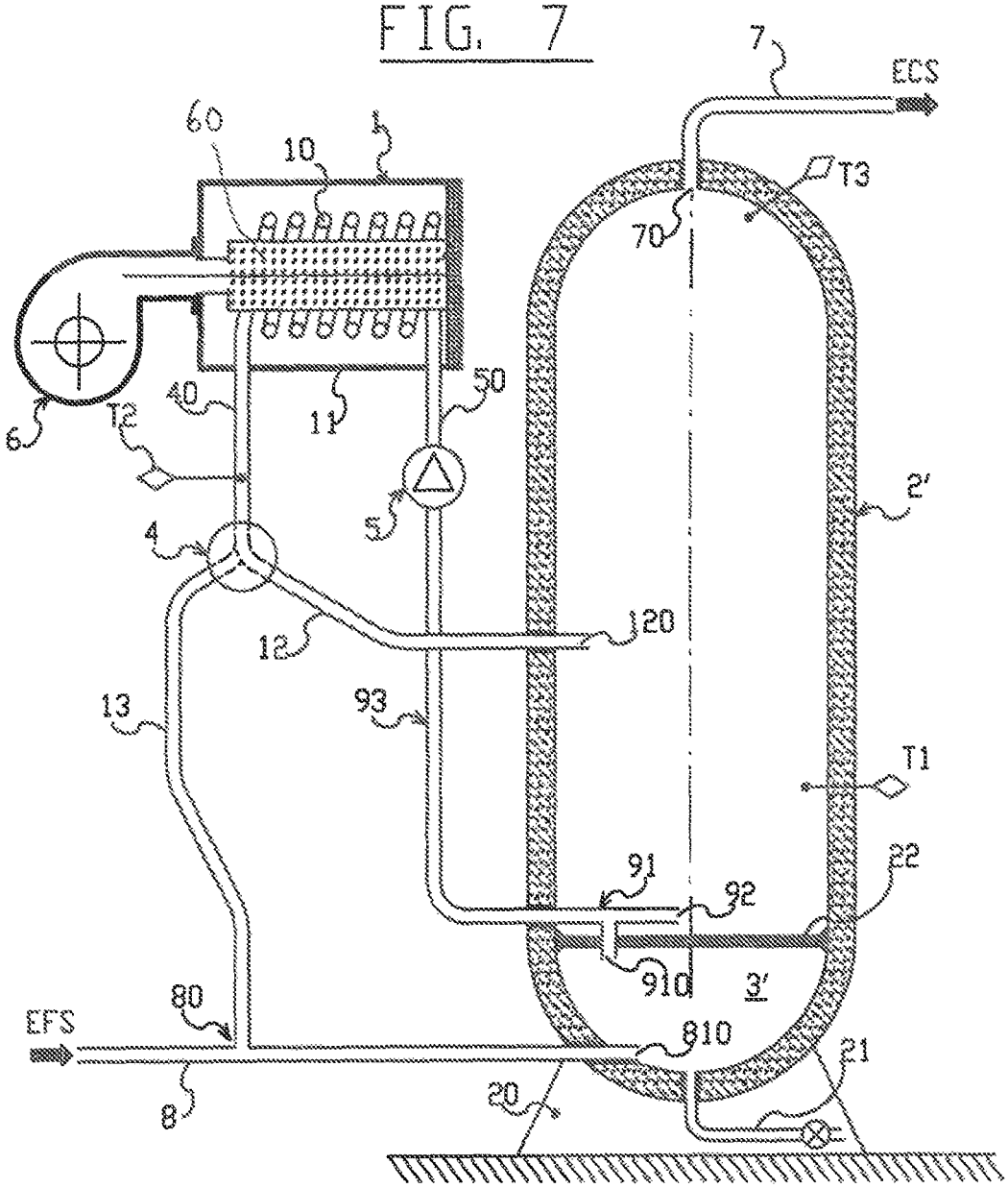
FIG. 7 illustrates an alternative of the installation, in which the small tank is integrated into the bottom of the storage tank.

On the alternative installation according to the invention which is illustrated in FIG. 7, the same reference marks are used as in the previous figures for designating identical or similar components.

This embodiment is essentially distinguished from the previous one in that the storage tank—designated here as 3'—is not separated here from the storage tank—designated here as 2'—, but is an integral part of it.

More specifically, the small tank 3' occupies the inner volume of the hemispherical bottom cap of the tank 2' and is separated from the inner volume of the latter by a horizontal partition 22.

The cold water intake conduit 8 opens out directly into the tank 3' through an outlet orifice 810.

The first "T" connector designated herein as 91, is positioned inside the storage tank 2'.

It comprises a vertical branch 910 which passes through the partition 22, while its horizontal branch on one side opens out through tubing 92 into the tank 2', just above this partition 22; its other horizontal tubing is connected to a bypass conduit 93 connected to the pump 5.

This installation works in the same way that the one previously described.

In the case of normal drawing of sanitary hot water, the boiler 1 and pump 5 running, with the valve 4 having the conduits 40 and 12 communicate with each other, the sanitary cold water enters through the conduit 8 in the constitutive compartment 3' of the small storage tank, flows out therefrom through the tubing 910, is mixed with hot water from the tank 2' through the tubing 92, and this mixture is driven back towards the boiler through the conduits 93 and 50 by means of the pump 5. The water heated by the boiler 1 returns into the tank through the conduits 40 and 12 via the valve 4.

In the case of stopping the drawing of sanitary hot water, in a first phase, the UEC maintains the pump 5 and boiler 1 running, without changing the position of the valve 4. Mixing of the hot water is then observed with it being circulated in a closed circuit, the flow path to the boiler passing through the conduits 93 and 50, and the return path to the tank through the conduits 40 and 12. The small tank 3', filled with cold water remains isolated. The probe $T_2$ regulates the power of the burner which decreases gradually as the temperature rises in the tank 2'. When the whole of the tank is at the intended temperature as measured by the probes $T_1$ and $T_3$, the UEC orders stopping of the burner 60.

At this moment, the switching of the valve 4 into the position having the conduits 40 and 13 communicate with each other, is performed, the pump 5 being kept running.

Circulation of water in a closed circuit is then observed from the small tank 3' towards the boiler (switched-off) 1 via the tubing 910, the conduit 93, the pump 5 and the conduit 50, and then return to the small tank 3' via the conduit 40, the three-way valve 4, the bypass conduit 13 and the conduit 8.

By means of this arrangement, the cold water contained in the small tank 3' very rapidly causes cooling of the boiler coil 10, in order to result in an intermediate final temperature of the order of 35-40° C.

The UEC then orders by timing the stopping of the pump 5.

The water present in the conduits is thus at a too low temperature so that no limestone is deposited on the walls of these conduits with the risk of scaling them, according to the sought goal.

In the absence of water being drawn, the tank 2' remains isolated and the hot water which it contains remains at the set temperature, for example 65° C.

As in the first embodiment, the UEC may be programmed so that in the case of "small amounts of water being drawn" corresponding to low flow rates and/or to short periods of request of sanitary hot water, the system remains in the previous state (boiler switched off, pump stopped and valve in the bypass position).

This avoids the occurrence of untimely stopping/starting phases for "small amounts of water being drawn".

In this configuration, the sanitary cold water flow rate entering through the orifice 810 of the conduit 8 is the same as that of hot water leaving the tank 2 through the orifice 70 of the conduit 7.

In a first phase, the inflowing cold water expels the water at an intermediate temperature which occupies the small tank 3', and the mixture is driven back through the tubings 910 and 92 of the connector 91 in order to be diffused at the base of the tank 2.

With continuation of small amounts of water being drawn, i.e. continuously, it is finally cold water which arrives at the base of the tank 2, with a relatively clear temperature transition between the lower volume (at low temperature) and the upper volume (at high temperature) of the water present in the tank. The level of this transient area gradually rises depending on the volume of drawn water, and ends up by reaching the level of the probe $T_1$.

Below a determined threshold value of the temperature at this level, the UEC orders restarting of the boiler and brings the installation back into its normal initial operating state.

The invention claimed is:

1. An installation for producing sanitary hot water, which comprises a boiler, a tank for storing hot water, a sanitary cold water intake conduit, a conduit for feeding the boiler with water to be heated, provided with a pump capable of ensuring circulation of the water to be heated towards the boiler when the pump is started and of preventing the circulation when the pump is stopped, a conduit for drawing sanitary hot water, and a conduit for the outflow of the heated water from the boiler, wherein said sanitary cold water intake conduit is connected via a first "T" connector to the boiler feeding conduit and to a recirculation conduit opening out into a low portion of the tank for storing hot water, while the boiler outlet conduit opens out approximately at a half-height of the hot water storage tank and the water drawing conduit opens out into an upper portion of the hot water storage tank, the sanitary cold water intake conduit being provided with a second "T" connector placed upstream from the first "T" connector, wherein:

a portion of the sanitary cold water intake conduit connects the second and first "T" connectors, the portion being equipped with a small storage tank that is positioned between said first and second "T" connectors, a capacity of the small storage tank being less than that of the hot water storage tank; and the conduit for the outflow of the heated water out of the boiler is equipped with a three-way valve which is connected through a bypass conduit to the second "T" connector, the three-way valve selectively occupying either a primary position, in which the three-way valve has the boiler outlet communicate with the half-height portion of the hot water storage tank, to distribute the water issued from the boiler in the half-height portion of the hot water storage tank, or a secondary position, in which the three-way valve has the boiler outlet communicate with the bypass conduit to distribute the water issued from the boiler in the bypass conduit.

2. The installation according to claim 1, wherein the boiler is a gas or fuel oil boiler.

3. The installation according to claim 2, wherein the boiler includes a gas or fuel oil burner capable of heating the water circulating in a tubular coil in stainless steel which surrounds the burner.

4. The installation according to claim 1, wherein the capacity of the small storage tank is approximately equal to the capacity of the whole of the tubing connected to the hot water storage tank, downstream from the second "T" connector, including the tubing passing through the boiler.

5. The installation according to claim 1, wherein said small storage tank is independent of said hot water storage tank and is located outside the hot water storage tank.

6. The installation according to claim 1, wherein said small storage tank forms a compartment of said hot water storage tank and is located in the lower portion of the hot water storage tank.

7. The installation according to claim 1, wherein said three-way valve is a solenoid valve.

8. The installation according to claim 7, further comprising at least three temperature sensors capable of measuring the temperature of the water which circulates therein, the at least three temperature sensors including:

a sensor which senses the temperature inside the hot water storage tank in the low portion of the hot water storage tank, but at a level above the one at which said recirculation conduit opens out;

a sensor which senses the temperature at the outlet of the boiler; and a sensor which senses the temperature inside the hot water storage tank in the upper portion of the hot water storage tank, in proximity to the inlet of the water-drawing conduit.

9. The installation according to claim 8, wherein the installation is equipped with a control and regulation circuit comprising a control unit capable of controlling the starting or stopping of the boiler and of the pump and of controlling the three-way valve depending on temperature signals which are provided to the valve by the temperature sensors according to a determined operating program.

10. The installation according to claim 1, wherein a first portion of the small storage tank is fluidly connected with a first section of said sanitary cold water intake conduit, such that the first portion is effective to intake cold water from said sanitary cold water intake conduit, and a second, different portion of the small storage tank is fluidly connected with a separate second section of said sanitary cold water intake conduit, such that the second portion is effective to discharge cold water from said small storage tank.

* * * * *